US006170087B1

(12) United States Patent
Brannon

(10) Patent No.: US 6,170,087 B1
(45) Date of Patent: Jan. 9, 2001

(54) ARTICLE STORAGE FOR HATS

(76) Inventor: Garry A. Brannon, 5715 Spence Cir., College Park, GA (US) 30349

( * ) Notice: Under 35 U.S.C. 154(b), the term of this patent shall be extended for 0 days.

(21) Appl. No.: 09/370,986

(22) Filed: Aug. 10, 1999

Related U.S. Application Data

(60) Provisional application No. 60/097,807, filed on Aug. 25, 1998.

(51) Int. Cl.[7] ..... A42B 1/24
(52) U.S. Cl. ..... 2/209.13
(58) Field of Search ..... 2/195.1, 175.1, 2/209.13, 209.12

(56) References Cited

U.S. PATENT DOCUMENTS

| | | | | |
|---|---|---|---|---|
| D. 333,375 | | 2/1993 | Ouellette . | |
| 441,805 | * | 12/1890 | Parker | 2/209.13 |
| 4,451,935 | * | 6/1984 | Henschel | 2/209.13 |
| 5,233,703 | | 8/1993 | Galka . | |
| 5,359,733 | | 11/1994 | Brannon et al. . | |
| 5,367,713 | | 11/1994 | McCallum . | |
| 5,539,929 | | 7/1996 | Revson . | |
| 5,557,807 | * | 9/1996 | Hujar | 2/171.2 |
| 5,666,668 | | 9/1997 | Ronquillo . | |
| 5,724,678 | * | 3/1998 | MacCallum et al. | 2/209.13 |

* cited by examiner

*Primary Examiner*—Bibhu Mohanty
(74) *Attorney, Agent, or Firm*—Richard C. Litman

(57) ABSTRACT

Various embodiments of article storage systems for hats and headgear provide for the removable storage of various articles within or on a hat or hats. In one embodiment, the hat includes multiple attachment points along the inner surface for the storage of embroidered emblems, patches, and similar articles within the hat, and one or more attachment points on the outer surface of the hat for the selective display of one or more of the emblems. In another embodiment, a multiple compartment wallet is provided, which may be removably stored within the hat by securing it to the inner surface of the hat. The wallet provides for the temporary storage of folding money, a credit card(s), driver's license or other identification, a car key(s), etc., while the wearer of the hat is casually dressed in apparel without other storage pockets (e.g., swimsuit and t-shirt, etc.). At least one wallet embodiment may include an identification window and lanyard attachment, for suspending from the neck of a person for display of the identification. The present invention also includes a kit for installing various article attachment points on and within a preexisting favorite hat, thus enabling a person to provide storage and display points on an existing hat, rather than being required to purchase an otherwise undesirable hat in order to have a hat with the storage and display features of the present invention.

6 Claims, 5 Drawing Sheets

ARTICLE STORAGE FOR HATS

REFERENCE TO RELATED PATENT APPLICATION

This application claims the benefit of U.S. Provisional patent application Ser. No. 60/097,807, filed on Aug. 25, 1998.

BACKGROUND OF THE INVENTION

1. Field of the Invention

The present invention relates generally to hats, caps, and other headgear, and more specifically to means providing for the storage of relatively flat and unobtrusive articles on and within a hat. The articles stored may comprise interchangeable flat embroidered patches, emblems, or the like, such as for sports team logos, and/or a thin, flat, multiple compartment wallet for the storage of various articles such as a credit card, car key, folding money, etc. within the hat.

2. Description of the Related Art

The decorative embellishment of a hat, cap, or other headgear has been a popular endeavor since the earliest of times. More recently, with the development of the so-called "baseball" cap, with its relatively close fitting crown and extended partial brim or bill, it has become popular to place a sports team emblem or logo, or some other design or display, at the front of the cap immediately above the bill, or in some other location on the cap.

Such hats and caps make excellent souvenirs for sports fans attending a game, auto race, or other activity, or may be purchased to show membership in or allegiance to a specific club or association or the like. Indeed, it has become difficult to find such a hat or cap for casual wear, which does not include some form of design, indicia, or logo thereon.

Most such hats and caps have such patches and similar articles permanently attached to the hat in some way or another (e.g., stitched in place, etc.). However, in many instances it may be desirable for the owner or wearer of the hat to remove the particular display article on the hat. Changes in team or brand allegiance, relocations to different areas having different local sports teams, as well as other reasons and circumstances, can result in a desire to change the emblem or display on a hat or cap.

Many times, the owner of a given hat or cap has become quite attached to the particular headgear article, due to a particularly comfortable fit, style, durability of the material, or for whatever reason. Yet, due to the permanently installed emblem or display on the hat, it has become less than suitable for wear under certain circumstances. Accordingly, various hats have been developed in the past which provide for the removability and temporary installation of such patches, emblems and the like. The present inventor has developed one such hat in the past, with the invention being disclosed in U.S. Pat. No. 5,359,733, incorporated herein by reference, issued to the present inventor on Nov. 1, 1994 and discussed further below.

Such earlier hats with removable patches or the like, still do not respond to all of the needs in such headgear. For example, some persons may have a favorite hat which has no means for the temporary, removable attachment of one or more display articles thereon, but which they wish to keep and provide for such removable attachment, rather than purchasing another hat which already has such a feature. Another problem with such hats with removable attachments, is that generally no means is provided for the storage of unused patches, emblems and the like within the interior of the hat, when such unused emblems are not being displayed on the outer surface of the hat. Such is the case with the present inventor's earlier hat of the '733 U.S. Patent noted further above, in that storage for unused patches was provided for on a separate display board, rather than within the hat itself.

Another desirable feature of such a hat, would be the storage of other articles within the hat for safekeeping during times when no other suitable storage means was being worn by the wearer of the hat, such as while wearing shorts and a t-shirt, or other apparel without sufficient pockets for the storage of at least some limited amount of valuables. Others have developed such hats in the past, but as in the case of earlier hats with temporarily attachable and removable patches and the like, such hats require the purchase of the specific hat which includes such a feature or features. The person desiring such a feature or features in an existing favorite or special hat, is left out in such circumstances.

Accordingly, a need will be seen for a provision for article storage within a hat, for the temporary and removable storage of patches, emblems, and the like which may also be interchangeably displayed on the outer surface of the hat as desired. A need also exists for the provision of a kit, which will allow a person to modify an existing hat to provide for the removable storage of emblems and similar articles therein, and further to provide for the interchangeable display of at least one emblem or the like on the exterior of the hat. Finally, a further need exists for the provision of means for removably storing a wallet or the like within the interior of a hat, and for a kit for modifying an existing hat to provide for such removable storage.

A discussion of the related art of which the present inventor is aware, and its differences and distinctions from the present invention, is provided below.

U.S. Pat. No. 441,805 issued on Dec. 2, 1890 to Alfred J. Parker, titled "Receptacle Or Holder In Hats," describes an insert for removably installing in a hat, for holding various relatively bulky articles therein. The Parker insert is not permanently attached to the hat, as is the article storage attachment of the present invention. Moreover, the principle used to secure an article using the Parker attachment is completely different than that used in the present invention, as Parker relies upon a resilient spring or band to secure articles between the jaws of a clasp within the crown of the hat.

U.S. Pat. No. 4,451,935 issued on Jun. 5, 1984 to Edward W. Henschel, titled "Head Covering Equipped With Double Pocket," describes a baseball style cap having a double pocket permanently stitched in place on one external surface thereof. The device is obtrusive, as it is disposed upon the outer surface of the cap, where it attracts attention to the storage of valuables or other articles therein. As the device is permanently installed upon the cap, it cannot be removed for safekeeping when the hat is removed and stored elsewhere. Moreover, one must purchase the hat and pocket combination together, as the two components are permanently secured together; one cannot purchase only the pocket portion of the Henschel head covering, for installation upon another favorite hat. In contrast, the present invention provides for the removable placement of a wallet or other article within the interior of a hat, as well as for the display of emblems or other related devices on the exterior of the hat and storage of unused emblems within the hat. The present invention also provides a kit for the modification of an existing hat, in order that the existing hat may provide the desired functions of the present invention.

U.S. Pat. No. 5,233,703 issued on Aug. 10, 1993 to Gordon P. Galka, titled "Headwear With Identification Pocket," describes a baseball style cap having a pocket disposed beneath the bill of the cap. The pocket is permanently attached to the underside of the bill, unlike the removably securable wallet of the present invention, which secures within the crown portion of the hat where it is completely concealed. Also, Galka does not provide any means for removably securing an emblem or other display article to the exterior of his hat, nor any means for storing such display articles within the hat when they are not on display, as does the present invention. Moreover, Galka does not provide any means of modifying an existing hat after manufacture to accommodate his invention, whereas the present invention provides for such modification of an existing hat if so desired.

U.S. Pat. No. 5,359,733 issued on Nov. 1, 1994 to Garry A. Brannon et al., titled "Patch Attachments For Hats," describes a baseball style cap having one component of hook and loop fastening material (e.g., Velcro™,) secured to one or more places on the exterior thereof. The hook and loop material provides for the interchangeable attachment of various patches or the like to the hat, with the patches each including a portion of hook and loop material adapted for securing to that installed to the exterior of the cap. The Brannon et al. '733 U.S. Patent does not disclose any means of storing unused patches within the cap, by securing them to mating hook and loop material secured to the inner surface of the cap, as provided by the present invention. Rather, the Brannon et al. '733 U.S. Patent only provides for storage of the patches on a separate display board, which is not a part of the present invention. Moreover, the Brannon et al. '733 U.S. Patent does not provide any means of securing a wallet within the hat, nor any means of modifying a previously manufactured, existing hat to have the emblem, patch, or wallet display and storage capability as provided by the present invention.

U.S. Pat. No. 5,367,713 issued on Nov. 29, 1994 to Timothy P. McCallum, titled "Convertible Hat And Bag Assembly," describes various embodiments of a billed cap having a bag or container adjustably attached thereto. The bag may be stored within the hat when the hat is deployed, or the hat (including the bill) may be stored within the deployed bag or container. However, McCallum does not provide any means for displaying any articles on the exterior surface of the hat, nor for storing any articles on the interior surface of the hat. The hat and bag of the McCallum patent are a specially formed and constructed assembly, and cannot be modified by a kit provided in the field for removably displaying and storing various articles on or within the hat, as is provided by the present invention.

U.S. Pat. No. 5,539,929 issued on Jul. 30, 1996 to Rommy H. Revson, titled "Cap With Sealable Compartment," describes a cap having an exterior compartment secured permanently thereto. No means is disclosed by Revson for removably attaching and displaying any articles on the exterior of the cap, nor for removably storing such articles within the cap. Moreover, Revson does not provide for the removable attachment of his compartment either to the exterior or to the interior of the hat. Also, Revson requires that his hat and its attached storage compartment be purchased together as a single commodity, rather than providing any means of modifying an existing hat for the removable attachment of a storage compartment or other article thereto, as provided by the present invention.

U.S. Pat. No. 5,666,668 issued on Sept. 16, 1997 to Chad N. Ronquillo, titled "Cap With Front Size Adjustment And Rear Flap," describes a cap having a generally hemispherical crown wit a drape depending from the rearward band or periphery of the cap The cap may also include a chin strap. Ronquillo does not disclose any means of removably securing any emblem, patch, or other article to the exterior or interior of his cap, as provided by the present invention. Moreover, Ronquillo does not disclose any form of storage compartment, wallet or the like, which may be removably attached to the interior of his cap, nor any means of modifying an existing hat or cap to provide such storage features, as provided by the present invention.

U.S. Pat. No. 5,724,678 issued on Mar. 10, 1998 to Timothy P. McCallum et al., titled "Hat With Storage Pocket," describes several embodiments of hats having either permanently installed or removable storage pockets disposed therein. In the case of the removable pocket embodiment, the hat is specially constructed to have an inner layer of release material (i.e., hook and loop fastener material) disposed over a large portion of the interior of the hat crown, or at least "provided as a tape or strip sewn along the hat seams." (Column 4, lines 51–52.) While the present that may include removable components therein, the attachment means does not require installation at the time the hat is constructed, as in the case of the McCallum inner liner or tapes or strips, which are sewn into the hat at the time of manufacture. Rather, the attachment means for various articles on or in the present hat, may be added after the manufacture of the hat or to an existing hat, and do not require a specially constructed hat. Moreover, the removable pocket embodiment of the McCallum hat has only a single compartment therein, whereas the wallet of the present invention contains multiple compartments for the storage of a plurality of different articles therein, such as folding money, a credit card(s), driver's license or other identification, and/or a key(s) etc., as desired. McCallum is silent regarding the removable installation or display of other articles on the exterior of his cap, or regarding storage of such display articles within his cap or hat, both of which features are provided in the present invention.

Finally, U.S. Pat. No. D-333,375 issued on Feb. 23, 1993 to David Ouellette, titled "Combined Cap And Back Pocket," illustrates a design for a baseball style cap having a generally rectangular open pocket disposed upon the upper rear exterior surface thereof. No means is apparent for displaying any articles upon the exterior surface of the Ouellette cap, nor for storing such articles upon the interior surface of the cap. Moreover, no means is apparent for removing the pocket from the Ouellette cap, whereas the wallet associated with at least one embodiment of the present cap invention, is removably installable to the interior surface of the present cap.

None of the above inventions and patents, taken either singly or in combination, is seen to describe the instant invention as claimed.

SUMMARY OF THE INVENTION

The present invention comprises various embodiments of article storage means for hats and headgear. One embodiment provides for the removable display of emblems, patches, etc. on one or more exterior panels of the hat, while also providing for removable storage of unused emblems and the like on the interior surface of the crown of the hat. Another embodiment provides for a multiple compartment wallet which may be removably secured to the interior surface of the hat. The wallet may be used for the secure carriage and storage of folding money, a credit card(s), driver's license and/or other identification, and/or a key(s), when the wearer of the hat is casually dressed without suitable pocketed storage means disposed elsewhere on his or her person. The wallet may also be used for the removable storage of patches, emblems, or other display articles when they are not being displayed upon the exterior of the hat. In yet another embodiment, the present invention may be provided in the form of a kit comprising a wallet and multiple attachment means which may be permanently installed within and on a favorite existing hat, to provide for the removable storage within the hat of the wallet and/or other articles, and for the removable display of a selected emblem, patch, or other article on the exterior surface(s) of the hat.

Accordingly, it is a principal object of the invention to provide improved article storage means for hats, comprising means for removably displaying one or more articles on the exterior of the hat, and for storing one or more articles within the hat.

It is another object of the invention to provide improved article storage means for hats in which one or more emblems, patches, or the like may be removably secured to the interior surface of the hat for selective display on the hat exterior.

It is a further object of the invention to provide improved article storage means for hats comprising a multiple compartment wallet which may be removably attached to the interior surface of the hat, for the storage of folding money, credit cards, identification, keys, and the like, as desired.

An additional object of the invention is to provide improved article storage means for hats in which the removable wallet may be used for the storage of emblems, patches, and the like, for their selective removable display on the exterior of the hat as desired Still another object of the invention is to provide improved article storage means for hats comprising a kit including a wallet and attachment means therefor, which means may be permanently secured to and within the hat to provide for the removable storage of the wallet and/or emblems within the hat, and for the removable display of such emblems on the exterior of the hat.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

The present invention comprises various embodiments of article storage means in hats and headgear, with the headgear and articles to be stored therein each including mating, complementary fastening means for removably securing the articles within the hat. A first embodiment is illustrated in FIGS. 1 and 2 of the drawings.

Figure 1:
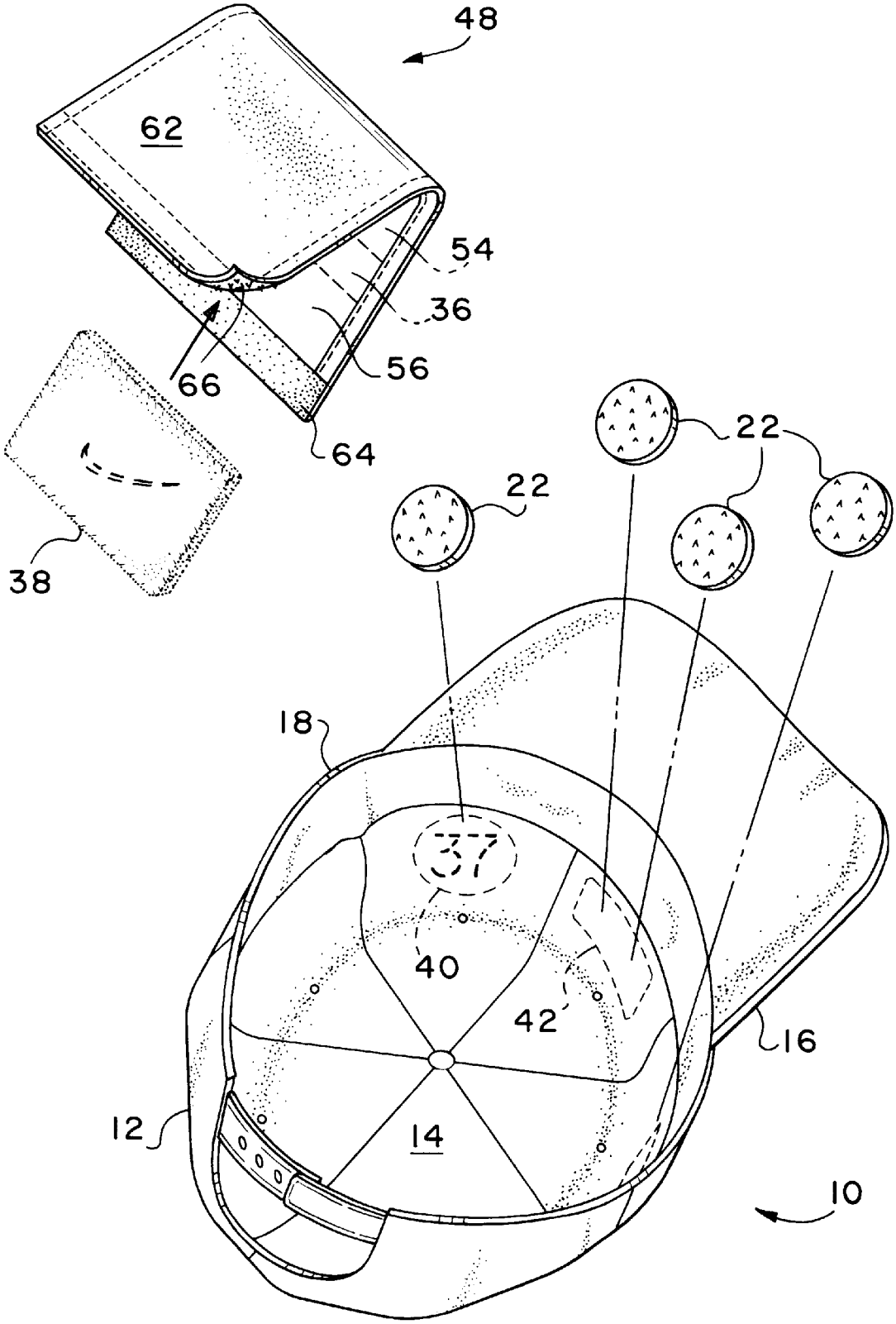
FIG. 1 is an exploded perspective view of the interior of a baseball style hat, showing the attachment of a plurality of attachment means therein for the removable attachment of a wallet and/or other emblems, patches or the like within the hat as desired.

In the first embodiment, a hat 10 including a crown 12 having an inner surface 14 is illustrated in FIG. 1. The hat 10 shown comprises a "baseball" type cap, with a generally hemispherical crown portion 12 and a bill or visor 16 extending from the forward portion of the band 18. It will be seen that the present invention is equally adaptable to other types of hats as well, such as the "Stetson" (tm) type hat 20 shown in FIG. 2.

At least one, and preferably a plurality, of attachment points 22 are permanently secured to the inner surface 14 of the hat 10, e.g., by stitching, adhesively securing, etc. The attachment points 22 each comprise a first type of fastener or fastening material, which is adapted to mate with a complementary second type of fastener or fastening material which is in turn permanently secured to an article to be removably stored or secured within the crown 12 of the hat 10. For example, small, round "coins" of hook and loop fastener material (e.g., Velcro, tm) have been found to work well as such attachment points. These small spots of material may be provided with a pressure and/or heat activated adhesive on their contact surfaces, allowing them to be easily applied to the inner surface 14 of the crown 12 of the hat 10 as desired.

Figure 2:
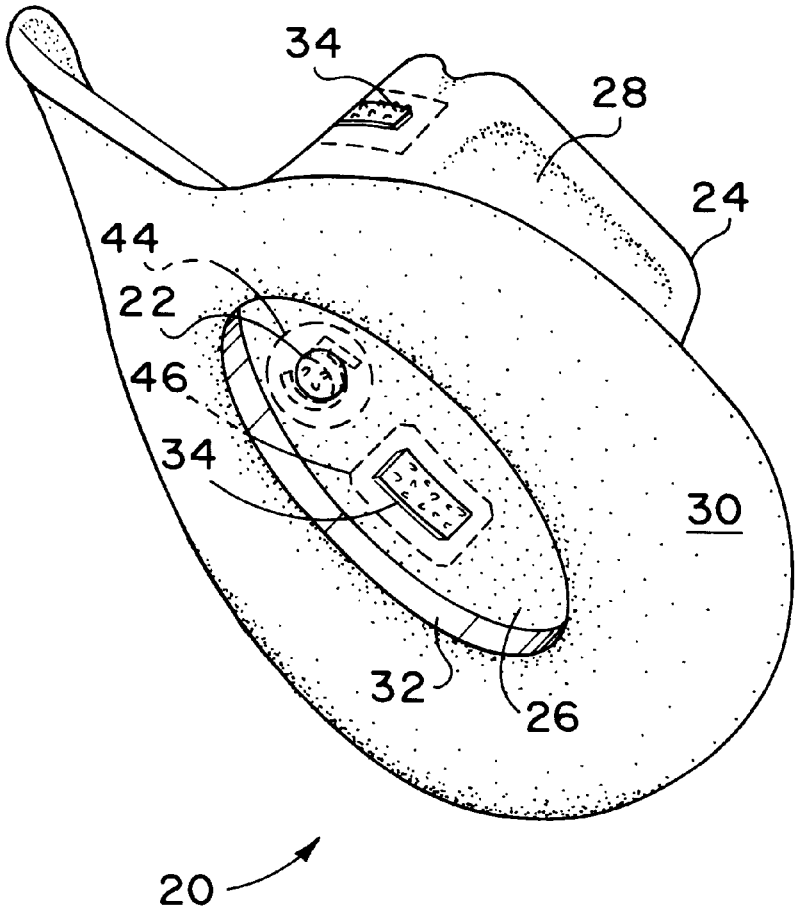
FIG. 2 is a perspective view of a fully brimmed, Stetson (tm) style hat, showing the installation of means for the removable attachment of emblems and the like therein and thereto.

The Stetson type hat 20 of FIG. 2 illustrates the configuration of such a hat, after such attachment points or fasteners have been permanently applied to the hat. The Stetson hat 20 of FIG. 2 comprises a crown portion 24, with the crown having an inner surface 26 and opposite outer surface 28. A brim 30 completely surrounds and extends from the band 32, as is conventional in such hats 20. A circular attachment point or fastener 22 has been permanently applied to the inner surface 26 of the crown 24 of the hat 20 of FIG. 2, with fasteners 34 having other shapes applied to other areas of the inner surface 26 and opposite outer surface 28 of the crown 24. It will be seen that the specific shape of the fasteners or attachment points 22 and/or 34 is not critical to the function of the present invention, and that any suitable shapes or configurations of such fasteners may be used.

The fasteners 22, 34, etc. which are permanently secured to the inner and outer surfaces of the hat crown, permit various articles having mating portions of fastening material to be temporarily and removably secured to the appropriate points or locations within and outside the crown of the hat. It should be noted that although no external attachment point is illustrated for the baseball type cap of FIG. 1, that such a point or points may be installed to such a hat 10, generally as described in U.S. Pat. No. 5,359,733 issued to the present inventor on Nov. 1, 1994, and incorporated herein by reference.

Various articles for storing within the hat may be provided with a mating, complementary second type of fastening material, such as the mating hook portion or loop portion of hook and loop fastening material. The precise type or configuration of fastener is not critical to the function of the present invention, so long as it mates securely with the first fastener material 22, 34, etc. which has been secured within and outside the crown of the hat. An example of such mating second material 36 is shown in broken lines in FIG. 1 and in the exploded perspective view of FIG. 3A, in which the second type of fastening material is shown removed from the wallet type hat storage article of that drawing Figure. It will be seen that such a fastener 36 may be provided in any suitable shape and size (circular, rectangular, etc.) to fit a given patch or emblem, such as the emblem 38 shown in FIG. 1, or emblems 40 through 46 shown in broken lines, installed respectively upon the inner surfaces 14 and 26 of the crowns 12 and 24 of the hats 10 and 20 of FIGS. 1 and 2. Such emblems may comprise relatively flat and thin embroidered fabric patches, or other suitable display articles having a configuration suitable for temporary storage within the crown of a hat.

In many cases, a person may wish to be able to store valuables within the crown of a hat, which feature is provided e.g., by the device of U.S. Pat. No. 5,274,678 to McCallum and discussed in detail further above. As noted above, a person wishing to store valuables using the McCallum system, is forced to purchase the McCallum hat in order to be able to use the McCallum storage pocket.

In many cases, a person may already have a favorite existing hat, which the owner wishes to adapt for the storage of valuables, display articles and/or emblems, etc. The owner of the existing hat may wish to retain that hat for various reasons, such as the fit, material durability, style, etc., yet may wish to provide the advantages of some form of temporarily installable and removable article storage means within the hat.

Accordingly, the present invention also comprises a kit providing for such temporary article storage within an existing hat. The various components shown in FIG. 1 may be provided in kit form, with the purchaser of the kit already owning a preexisting hat, such as the cap 10 of FIG. 1, Stetson of FIG. 2, etc. The present kit comprises a relatively thin, flat device 48 for the storage of articles within a hat, such as the wallet type hat storage article device shown in its completed and assembled state in FIG. 1. The wallet 48 includes a second type of fastener material 36 disposed across one surface thereof (shown in broken lines in FIG. 1), which fastener 36 is removably attachable to a mating first type of fastener, e.g., the mating first fastener material 22 of FIG. 1. The kit also includes at least one, and preferably a plurality, of first fastener type attachments 22, which may be permanently secured to the inner surface 14 of the crown 12 of the hat 10, or to the inner surface of the crown of any other practicable type of existing hat, such as the inner surface 26 of the crown 24 of the Stetson type hat 20 shown in FIG. 2.

The first fastener component(s) 22 preferably include(s) a conventional pressure and/or heat activated adhesive material disposed upon the back surface thereof, i.e., the surface opposite that having the removable fastener disposed thereon. The component(s) 22 may be applied to the inner surface of the existing hat by pressing in place, and/or heating (e.g., with a clothing iron or the like), according to the type of conventional adhesive provided. It has been found that pressure sensitive adhesives used in such hook and loop fastener spots or patches, may be cured by using heat to provide an even stronger bond with the underlying material, as by heating in a clothes dryer after the pressure application of the fastener patch to the desired underlying material.

Figure 3A:
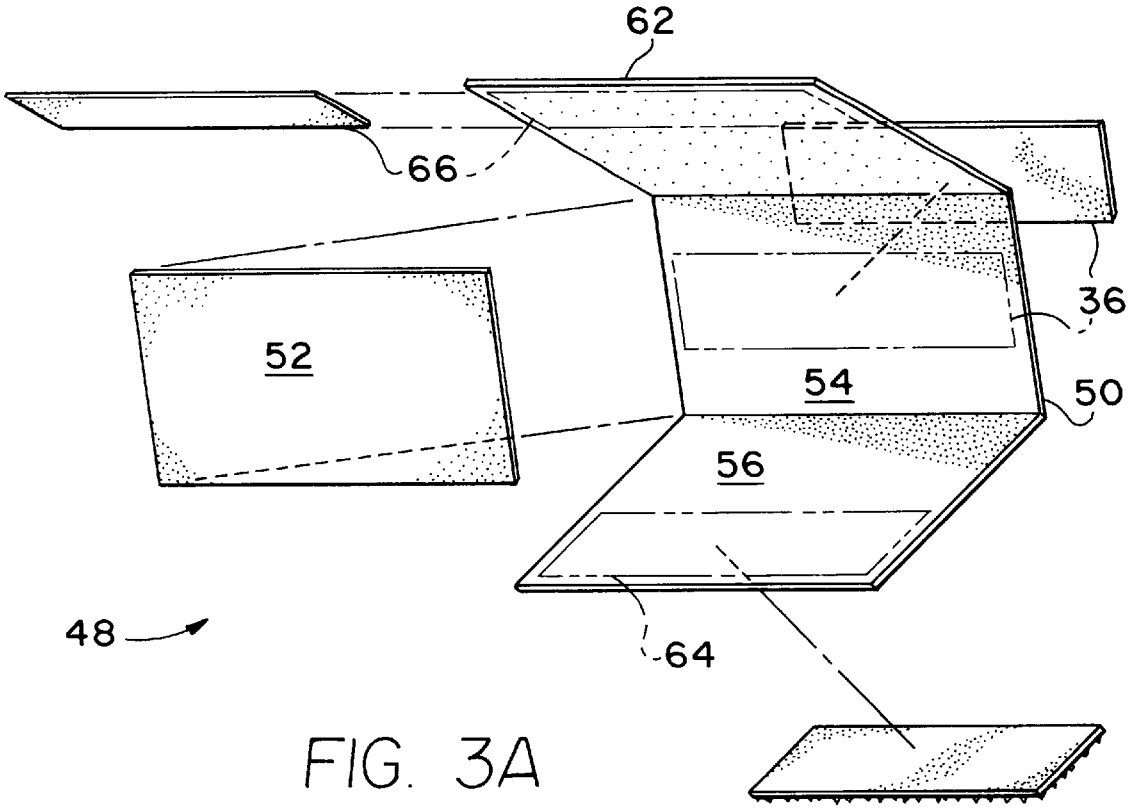
FIG. 3A is an exploded perspective view of a multiple compartmented let which may be used with the present invention.
Figure 3C:
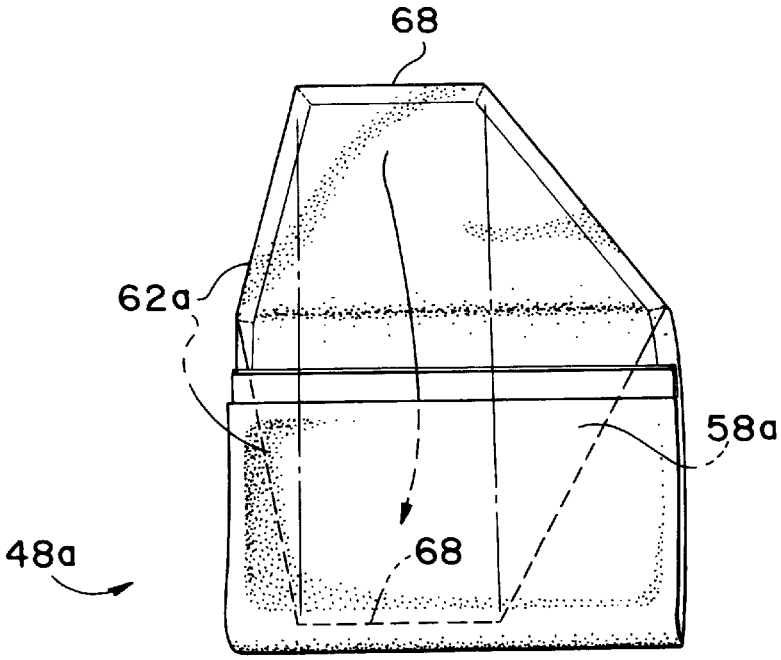
FIG. 3C is a perspective view of an alternative embodiment of the wallet of FIGS. 3A and 3B, showing a different type of closure flap.
Figure 3D:
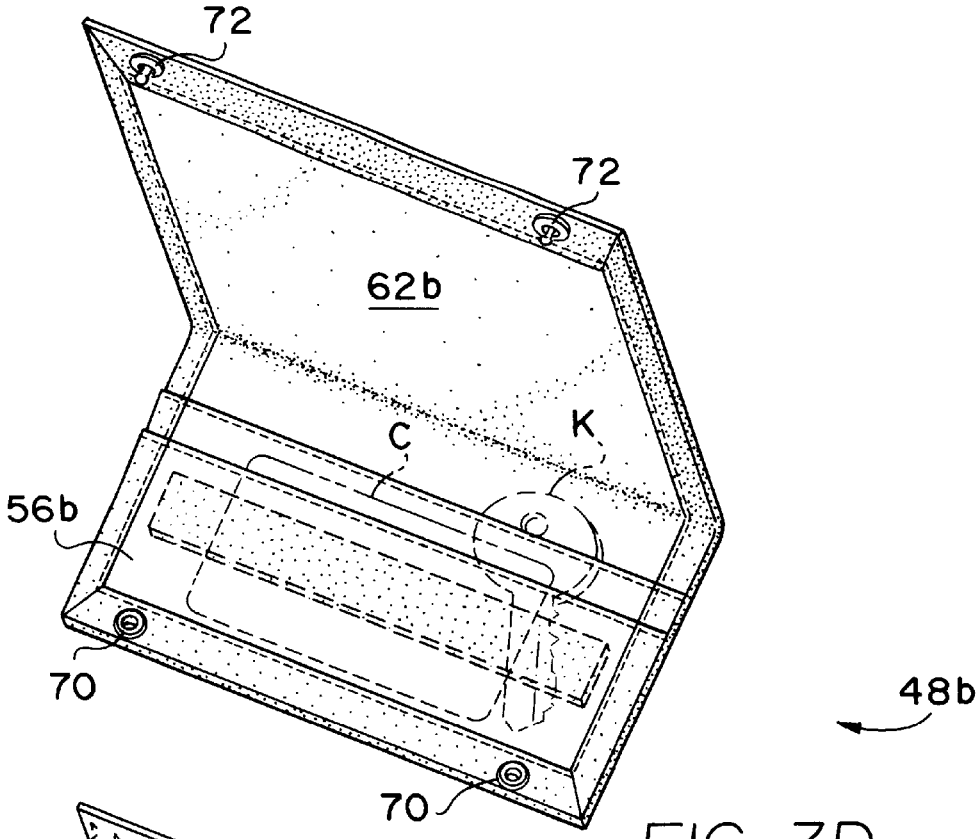
FIG. 3D is a perspective view of an alternative embodiment of the wallet of FIGS. 3A and 3B, showing a different type of flap securing means.
Figure 3B:
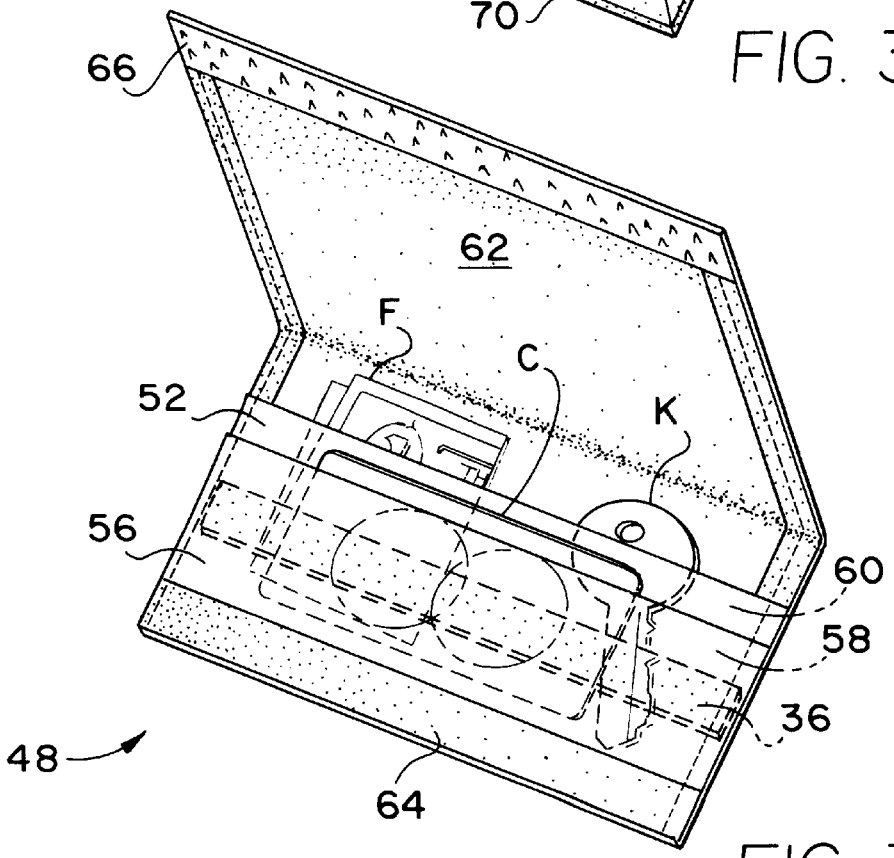
FIG. 3B is a perspective view of the assembled wallet of FIG. 3A in an open configuration, showing the placement of various articles therein.

The hat storage article or wallet may be constructed in any one of several embodiments, as illustrated in FIGS. 3A through 3D. FIG. 3A illustrates the construction of the wallet 48 of FIG. 1. The wallet 48 is essentially formed of a single continuous exterior panel 50, with a secondary internal divider 52 being installed (stitched, etc.) therein. The internal divider 52 is placed over the central or back panel 54 of the exterior panel 50, and one end portion 56 of the panel 50 is folded over the central or back panel 54 and permanently secured thereto (stitched, etc.) along their mating edges. The second fastener material 36 is permanently secured to the rear surface of the back panel 54, as shown in FIGS. 1 and 3A. The result is a double compartmented wallet 48, generally as shown in FIG. 3B.

It will be seen that the folded and stitched construction described above, defines a double compartmented wallet 48. A first or front compartment 58 is defined between the folded over and stitched end portion 56 and the second interior panel 52, with a second or rearward compartment 60 being defined between the second interior panel 52 and the central portion 54 of the main panel blank 50. It will be seen that additional compartments may be provided by increasing the number of interior panels 52. However, it is preferred that the present wallet 48 be kept relatively thin, in order to fit easily within the crown of a closely fitting hat, such as the baseball style cap 10 of FIG. 1.

The end portion of the panel blank 50 opposite the folded an stitched end portion 56, serves as a selectively openable closure flap 62. In the wallet 48 embodiment of FIGS. 1, 3A, and 3B, the main body of the wallet 48 includes a first portion of fastening material 64 disposed thereon, facing the opposed edge of the flap 62, with a mating, complementary second fastener portion 66. disposed along the facing edge or surface of the closure flap 62. Thus, when the closure flap 62 is folded over the opposed folded over and stitched end panel portion 56 and the two mating first and second fasteners 64 and 66 are brought together, the wallet 48 is sealed closed to secure any articles, such as folding money F, a credit card(s) and/or identification card(s) C, and/or a key(s) K, therein. The wallet 48 may then be removably installed in a hat by temporarily securing the second fastener material 36 of the wallet, to the mating first material 22 within the hat.

Alternative closure means for the hat storage wallet of the present invention are disclosed in FIGS. 3C and 3D. In FIG. 3C, the closure flap 62*a* is formed as a trapezoidal shape, with a distal edge 68 which is narrower than the main body of the wallet 48*a*. The distal edge 68 is tucked into the first or front compartment 58*a*, to secure the contents of the wallet 48*a* therein. The wallet 48*a* is then used in the manner described above for the wallet 48 of FIGS. 1, 3A, and 3B, for securing valuables within a hat as desired.

FIG. 3D illustrates a wallet 48*b* having another alternative closure means, comprising snap fasteners disposed at the facing edges of the folded over end panel 56*b* and closure flap 62*b*. A first type of fastener 70 disposed along the edge of the end panel 56*b* and a complementary second type of fastener 72 installed in mating disposition along the distal edge of the closure flap 62*b*. The first and second snap fasteners may be either male or female, so long as the mating fastener is of the opposite configuration. Preferably, the present wallet in any of its embodiments utilizes a rust free, non-metallic fastening means, such as the mating hook and loop fastener means disclosed further above, as the various wallet embodiments preferably provide some moisture and water resistance and are preferably formed of waterproof materials (synthetic fabrics, etc.). However, other fastener means (metal or plastic zippers, etc.) may be used in lieu of the various fastener means discussed above, if so desired.

Figure 4:
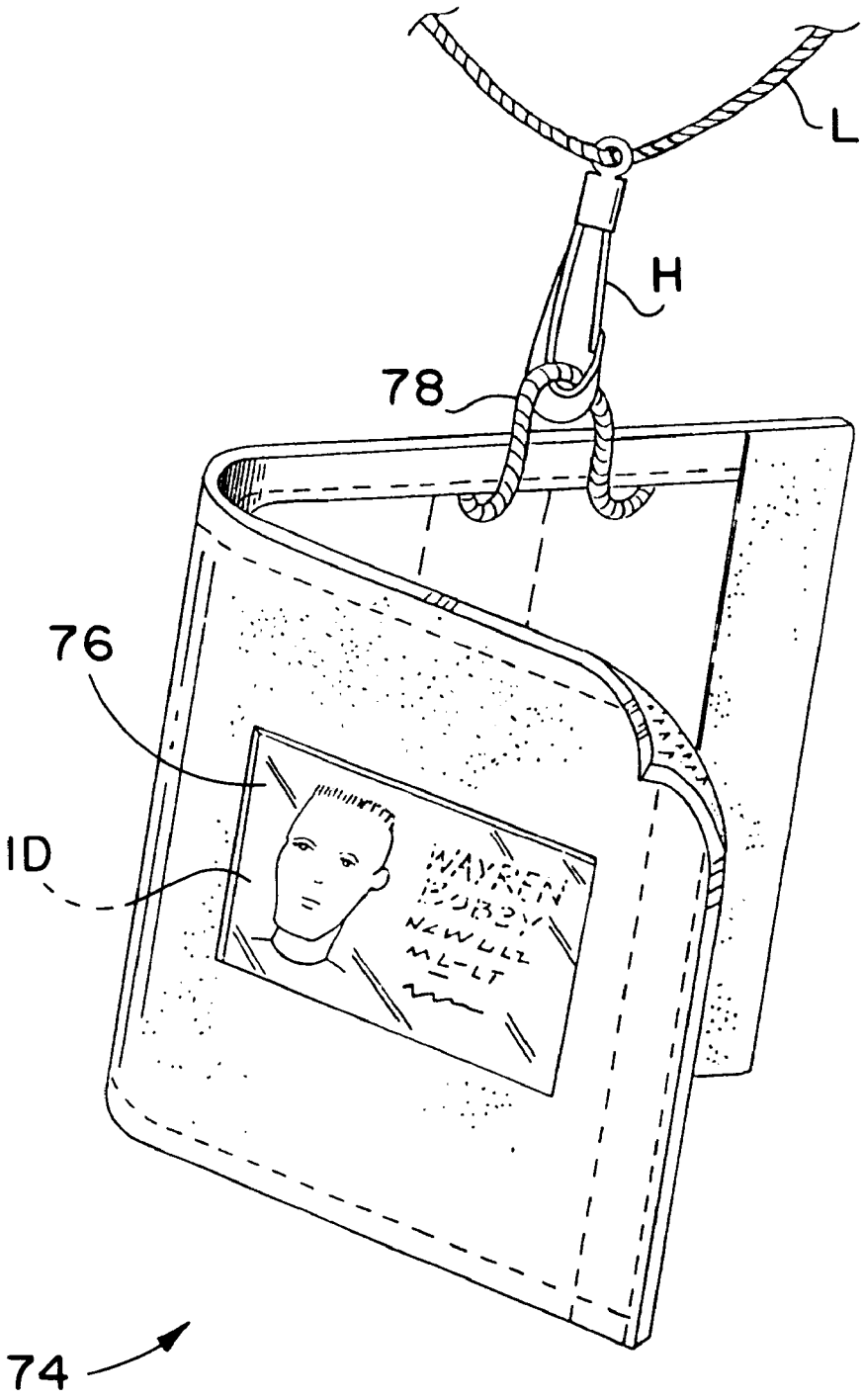
FIG. 4 is a perspective view of a wallet embodiment of the present invention, including lanyard attachment means and identification display means.

An additional embodiment of the wallet article of the present invention is illustrated in FIG. 4, and is designated as wallet 74. The wallet 74 embodiment may be modified from the wallet 48 of FIG. 1, or other wallet embodiments 48*a* and 48*b* illustrated in FIGS. 3C and 3D of the drawings. In many instances, it is required that persons wear and display identification badges, passes, or other display articles upon their person for access to various job or recreational activities, etc. Often the casual clothing appropriate for such activities does not provide any attachment means for displaying such identification or the like externally on the person. In other instances, an identification badge, card, or the like must be removed from a storage area and placed on display in a separate holder or the like.

The wallet 74 of FIG. 4 enables a person to keep such identification means ID permanently displayed through an externally disposed transparent window 76, where the identification ID is readily visible whenever window 76 of the wallet 74 is displayed. A suspension loop 78 or the like is also provided along one edge of the wallet 74, preferably positioned so that the identification ID being displayed within the window 76 will be upright when the wallet 74 is suspended from the loop 78. This arrangement permits the identification ID to be displayed at all times, merely by suspending the wallet 74 from a lanyard L and hook H disposed about the neck of a person, by means of the suspension loop 74. Means for attaching the wallet 74 within a hat for storage may also be provided, as in the wallets 48 through 48*b* discussed further above.

In summary, the present article storage means for hats provides a most useful means of securing and retaining various small and light articles to or within a hat. The provision of temporary fasteners permanently secured to the inner surface of the crown of a hat, provides an effective means for storing various articles within the hat for ease of access when desired. While at least one embodiment of the present invention is directed to the interchangeable storage of various display articles (embroidered patches, emblems, etc.) within the hat for interchangeable display on the outer surface of the hat, it will be seen that storage means for other articles may also be efficiently provided.

The provision of a wallet in combination with a hat, with the wallet and hat each including mating, complementary temporary fastening means for securing the wallet removably within the hat, enables informally clothed persons (joggers, sports participants, boaters, etc.) to retain various articles on their person, even though their clothing may not have sufficient pocket space to allow for the carriage of money, keys, etc. It will also be seen that the present wallet may be used for the storage of other articles, such as one or more emblems or embroidered patches or the like, as indicated in FIG. 1, thus precluding the need for multiple attachment points within the crown of the hat.

The wallet portion of the present invention may also include means for the display of identification, and/or means for suspending the wallet from a lanyard or the like for external carriage and display. This is particularly handy for workers and others who have occasion to wear casual clothing, but who must display some form of identification during their activities. As the present wallet is particularly useful for the carriage of critical items when a person is engaged in water sports, the wallet may be constructed of waterproof materials for greater durability and protection of articles carried therein. The foldable construction of the present flat and thin wallet is also particularly adaptable to folding around a belt for carriage, as well. Whether in kit form for an existing hat or in a hat and storage article combination, the present invention in any of its embodiments will prove to be a most useful accessory for anyone who has occasion to wear a hat with informal attire.

It is to be understood that the present invention is not limited to the embodiments described above, but encompasses any and all embodiments within the scope of the following claims.

I claim:

1. An article of headgear and a storage article for temporarily and removably securing within the headgear, comprising in combination:

a hat having a crown with an inner surface and an outer surface;

said inner surface of said crown including at least one first fastener type permanently affixed thereto;

a thin, flat wallet for temporarily and removably storing within said crown of said hat;

said wallet including a plurality of compartments therein and at least one second fastener type permanently secured thereto; and said second fastener type being removably attached to said first fastener type for temporarily and removably attaching said wallet within said crown of said hat as desired when said first fastener type is permanently secured therein.

2. The article of headgear and storage article combination according to claim 1, wherein said hat is selected from the group consisting of billed baseball style hats and Stetson hats having full brims.

3. The article of headgear and storage article combination according to claim 1, wherein said first fastener type and said second fastener type are selected from the group consisting of mating hook and loop fastening material and mating snap fasteners.

4. The article of headgear and storage article combination according to claim 1, wherein said wallet is waterproof.

5. The article of headgear and storage article combination according to claim 1, wherein said wallet includes suspension means for hanging said wallet from a suspension point.

6. The article of headgear and storage article combination according to claim 1, wherein said wallet includes at least one externally disposed transparent window for displaying identification therethrough.

* * * * *